US010113328B1

(12) United States Patent
Polisar et al.

(10) Patent No.: US 10,113,328 B1
(45) Date of Patent: Oct. 30, 2018

(54) CANOPY ASSEMBLY FOR PROVIDING PRIVACY

(71) Applicants: Steve Polisar, Miami, FL (US); Imke Achenbach, Miami, FL (US)

(72) Inventors: Steve Polisar, Miami, FL (US); Imke Achenbach, Miami, FL (US)

( * ) Notice: Subject to any disclaimer, the term of this patent is extended or adjusted under 35 U.S.C. 154(b) by 0 days.

(21) Appl. No.: 15/591,520

(22) Filed: May 10, 2017

(51) Int. Cl.

| | |
|---|---|
| ***E04H 15/06*** | (2006.01) |
| ***E04H 15/48*** | (2006.01) |
| ***E04H 15/54*** | (2006.01) |
| ***E04H 15/34*** | (2006.01) |

(52) U.S. Cl.
CPC ..... *E04H 15/06* (2013.01); *E04H 15/34* (2013.01); *E04H 15/48* (2013.01); *E04H 15/54* (2013.01)

(58) Field of Classification Search
CPC ..... E04H 15/48; E04H 15/02; E04H 15/06; E04H 15/34; E04H 15/40; E04H 15/405; E04H 15/425; E04H 1/1244; E04H 15/003; B60J 1/20; B60J 1/2047; B60P 3/341; B60P 3/32
USPC ..... 135/88.05, 88.07, 88.13, 88.15–88.18, 135/125–126, 128, 117, 119, 902, 143; 296/152, 158–161, 196
See application file for complete search history.

(56) References Cited

U.S. PATENT DOCUMENTS 1,741,424 A * 12/1929 Lundstrom ..... E04H 15/06 135/88.13
1,935,948 A 11/1933 Hyrup
1,990,804 A * 2/1935 Watson ..... E04H 1/1244 135/128
2,027,551 A * 1/1936 Rideout ..... E04H 15/06 135/88.13
2,122,681 A * 7/1938 Dykes ..... B60P 3/38 135/121
2,204,432 A 6/1940 Morgadanes
2,926,677 A 3/1960 Lalonde
3,002,518 A 10/1961 Maxwell
3,629,875 A * 12/1971 Dow ..... A47K 3/325 135/902
4,224,754 A * 9/1980 Derryberry ..... A01M 31/025 135/117
4,285,354 A * 8/1981 Beavers ..... E04H 15/30 135/120.3
5,301,706 A * 4/1994 Jones ..... E04H 15/001 135/125
(Continued)

*Primary Examiner* — Winnie Yip
(74) *Attorney, Agent, or Firm* — Malloy & Malloy, PL

(57) ABSTRACT

A canopy assembly for providing privacy comprising: a support assembly having a first and a second support structure each comprising a substantially round configuration and a bendable material that permits positioning the screen into and out of a "collapsed orientation"; a screen comprising a flexible and non-transparent material, the screen being connected to at least a portion of the first and the second support structure; an attachment assembly comprising two attachment structures each connected to different portions of the first support structure and also connected to different parts of a vehicle; two openings disposed on the screen, and configured and dimensioned to permit passage of an individual. The screen may be positioned into and out of an "expanded orientation" that comprises the screen forming a substantially cylindrical privacy enclosure on an inside of both the first and the second support structures.

20 Claims, 10 Drawing Sheets

(56) References Cited

U.S. PATENT DOCUMENTS

| | | | | |
|---|---|---|---|---|
| 5,311,620 | A | 5/1994 | Ratje | |
| 5,430,980 | A | 7/1995 | Ferrier | |
| 5,592,961 | A * | 1/1997 | Chin | E04H 1/1244 135/117 |
| 7,464,983 | B1 | 12/2008 | Acosta et al. | |
| 7,849,866 | B1 * | 12/2010 | Mangum | A47K 11/04 135/117 |
| 8,381,749 | B1 * | 2/2013 | Ashmore, Jr. | E04H 15/001 135/90 |
| 8,708,027 | B2 | 4/2014 | Howie et al. | |
| 2009/0056887 | A1 | 3/2009 | Britt | |
| 2013/0340159 | A1 | 12/2013 | Barrett | |
| 2015/0047118 | A1 | 2/2015 | Bilyk, Jr. | |

* cited by examiner

CANOPY ASSEMBLY FOR PROVIDING PRIVACY

BACKGROUND OF THE INVENTION

Field of the Invention

The present invention relates to a changing canopy assembly for providing privacy to an individual while changing clothes. The canopy assembly comprises a screen connected to a support assembly, and at least two openings disposed on the screen so that the individual may pass therethorugh.

Description of the Related Art

There are many instances in which it becomes necessary to make a change of clothes in locations where it otherwise would be difficult to achieve. For example, it may be desirable to quickly change clothes after going to the beach or swimming, or after a sporting event. Depending on the circumstance, it may be prohibitive to do so in a public location. There may not be an easily accessible room in which to change or there may be too many people needing a space or room in which to change clothes. Accordingly, there is a need to provide a canopy assembly that may be easily setup and folded for storage.

There would be a great advantage in providing a canopy assembly that could be used in conjunction with a vehicle. A great advantage would be realized by providing a canopy assembly that could be temporarily or removably connected to a vehicle, and disposed in communication with the exterior of the canopy assembly and with the interior of the vehicle. A further advantage would be realized by providing a canopy assembly comprising flexible or collapsible materials so that it may conveniently be folded and stored.

SUMMARY OF THE INVENTION

The present invention is directed towards a canopy assembly for providing privacy. The inventive canopy assembly may be used to provide privacy to an individual when a change clothes is desirable. This may be after going to a beach, a swimming pool, a sporting event, or during a similar circumstance. A feature of the canopy assembly according to the present invention is that it may be used in conjunction with a vehicle. The inside of the inventive canopy assembly may be disposed adjacent to the vehicle and in communication with both the exterior of the canopy and the interior of the vehicle. Thus, an individual may change clothes, and subsequently enter the vehicle directly without having to exit the canopy assembly.

The inventive canopy assembly comprises a support assembly and a screen connected to the support assembly. The support assembly generally comprises a first and a second support structure. A proximal end of the screen is connected to the first support structure, while a distal end of the screen is connected to the second support structure. The support structures should preferably have not only a continuous, but also a closed configuration. More specifically, the support structures may have a substantially round configuration. Other configurations are also possible and include, but are not limited to, square, elliptical, or rectangular. A privacy enclosure is thus formed inside of the screen and between the support structures. The footprint of the privacy enclosure should accommodate individuals of different sizes. When used in an operative orientation, the canopy assembly, and more specifically the screen, is disposed in a substantially vertical or upright position. In this vertical or upright position, the proximal and distal ends of the screen are also upper and lower ends, and the screen extends a height that is determined by the distance between the support structures. The height of the screen may vary according the height of the individual(s) and/or the size of the vehicle to which the canopy assembly will be attached.

The attachment assembly comprises at least two attachment structures each of which has a proximal end, a distal end, and an attachment device. The proximal end of each attachment structure is generally connected to at least a portion of the first support structure, while the distal end is generally connected by an attachment device to a supporting structure, which may be a vehicle. At least two attachment structures and corresponding attachment points, such as different parts of a vehicle, should be provided to give stability to the canopy assembly of the present invention.

The first and second support structures of the support assembly should comprise a "bendable material" capable of being folded. Either or both of first and the second support structures may be folded into smaller sizes for portability and/or storage of the canopy assembly. For example, each of the support structures may have a substantially round configuration and may be folded upon itself into a "double loop" or "stacked" configuration. Conversely, the bendable material should be sufficiently rigid so as to support the screen.

As used herein, the screen and the support assembly may be collectively disposed in an "expanded orientation." The "expanded orientation" comprises the first and second support structures being disposed in spaced relation to one another. Additionally, the "expanded orientation" also comprises the first and the second support structures disposed in a substantially parallel and centered alignment relative to one another. That is, the approximate center of both the first and second support structures should coincide. In embodiments comprising a first and a second support structure having a round configuration, the "expanded orientation" should result in the screen forming a substantially cylindrical privacy enclosure. As used herein, inside of the privacy enclosure is a privacy space that may be at least partially defined as the space inside of the first and second support structures, substantially along the height of the screen.

The screen generally comprises at least two openings, each of which is configured and dimensioned to permit passage of a person or individual therethorugh. When the screen is in the "expanded orientation," the interior of the canopy assembly, should be in communication with both the exterior of the screen, and the interior of the vehicle. At least a different opening should communicably connect the interior of the canopy assembly to the interior of a vehicle. Thus, an individual may enter the canopy assembly from the outside of the screen, change clothes inside of the canopy assembly, and enter the vehicle directly from the interior of the canopy assembly. Similarly, an individual may enter the canopy assembly from the vehicle, change clothes, and exit to the exterior of the canopy assembly.

The screen may also be disposed into and out of a "collapsed orientation" that comprises the screen and the support structures being collapsed or folded so that the canopy assembly may be stored with relative ease. The material of the screen should be non-transparent or translucent to provide an effective privacy enclosure. Additionally, the material of the screen should also be flexible so that it may at least partially conform to the geometry of the first and/or the second support structure. Additionally, the material of the screen should also be such that the screen may easily be collapsed and/or folded for storage.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 10:
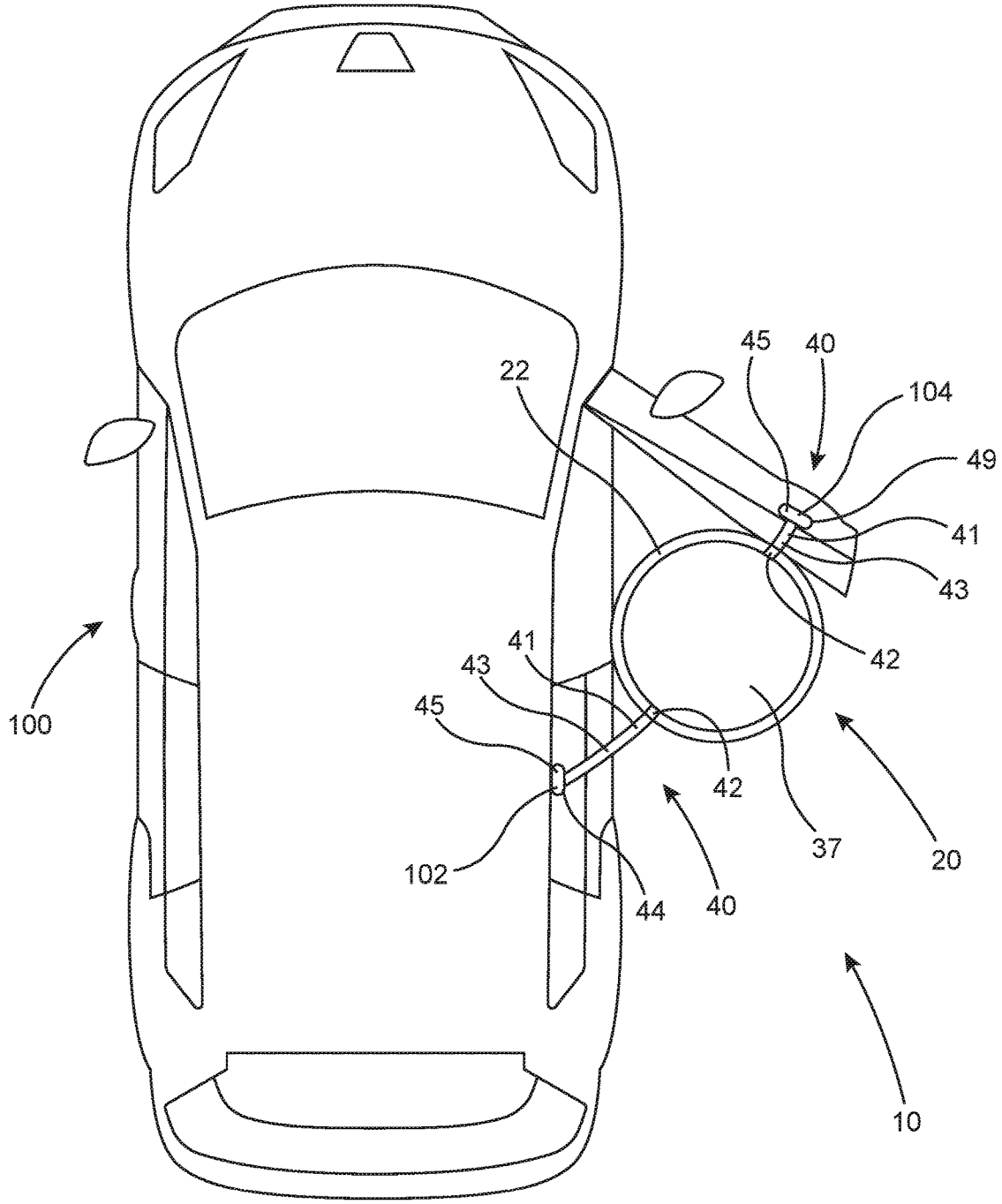
FIG. 10 is a top view of one embodiment of the canopy assembly according to the present invention connected to a vehicle.
Figure 11:
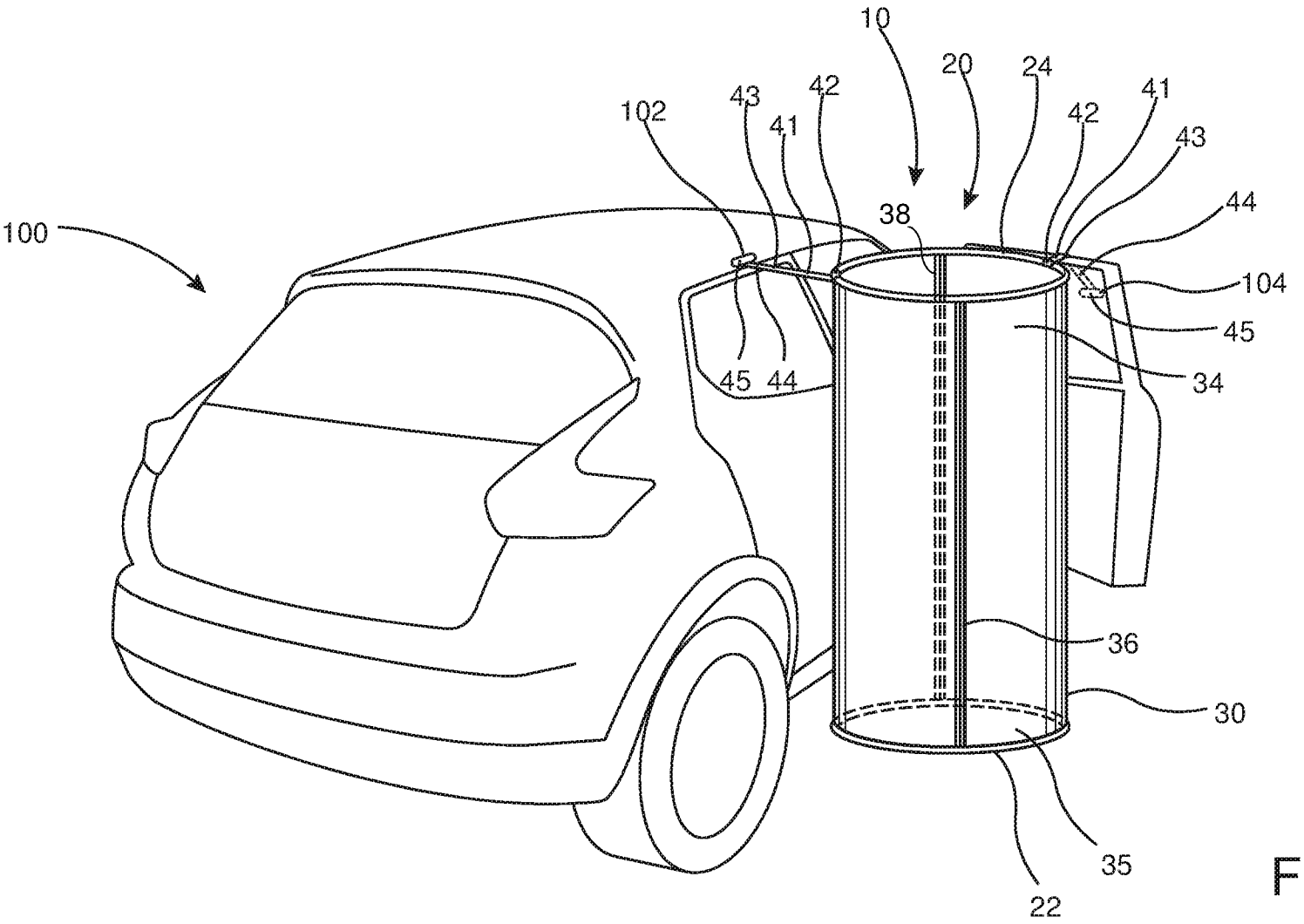
FIG. 11 is a perspective view of one embodiment of the canopy assembly according to the present invention connected to a vehicle.

The present invention is directed towards a canopy assembly, generally indicated as 10, used for providing privacy to an individual while changing clothes. As an example, privacy for a change of clothes may be necessary after a trip to the beach, the swimming pool, after a sporting event, or after other similar instances. The canopy assembly 10 of the present invention may be used in conjunction with a vehicle, generally indicated as 100, as schematically represented in FIGS. 10 and 11. The canopy assembly 10 may be attached to different parts of the vehicle 100 to provide support to the canopy assembly 10. Additionally, when attached to a vehicle 100, the canopy assembly 10 provides a privacy enclosure so that an individual may change clothes before entering the vehicle 100. Accordingly, one feature of the present invention is that an individual may access the canopy assembly 10 from the exterior. Once inside of the canopy assembly 10, an individual may directly access the inside of the vehicle 100 without having to exit the vehicle 100. Similarly, an individual may enter the canopy assembly 10 directly from the vehicle 100, change clothes while inside of the canopy assembly 10, and exit to the exterior of the canopy assembly 10.

Figure 1:
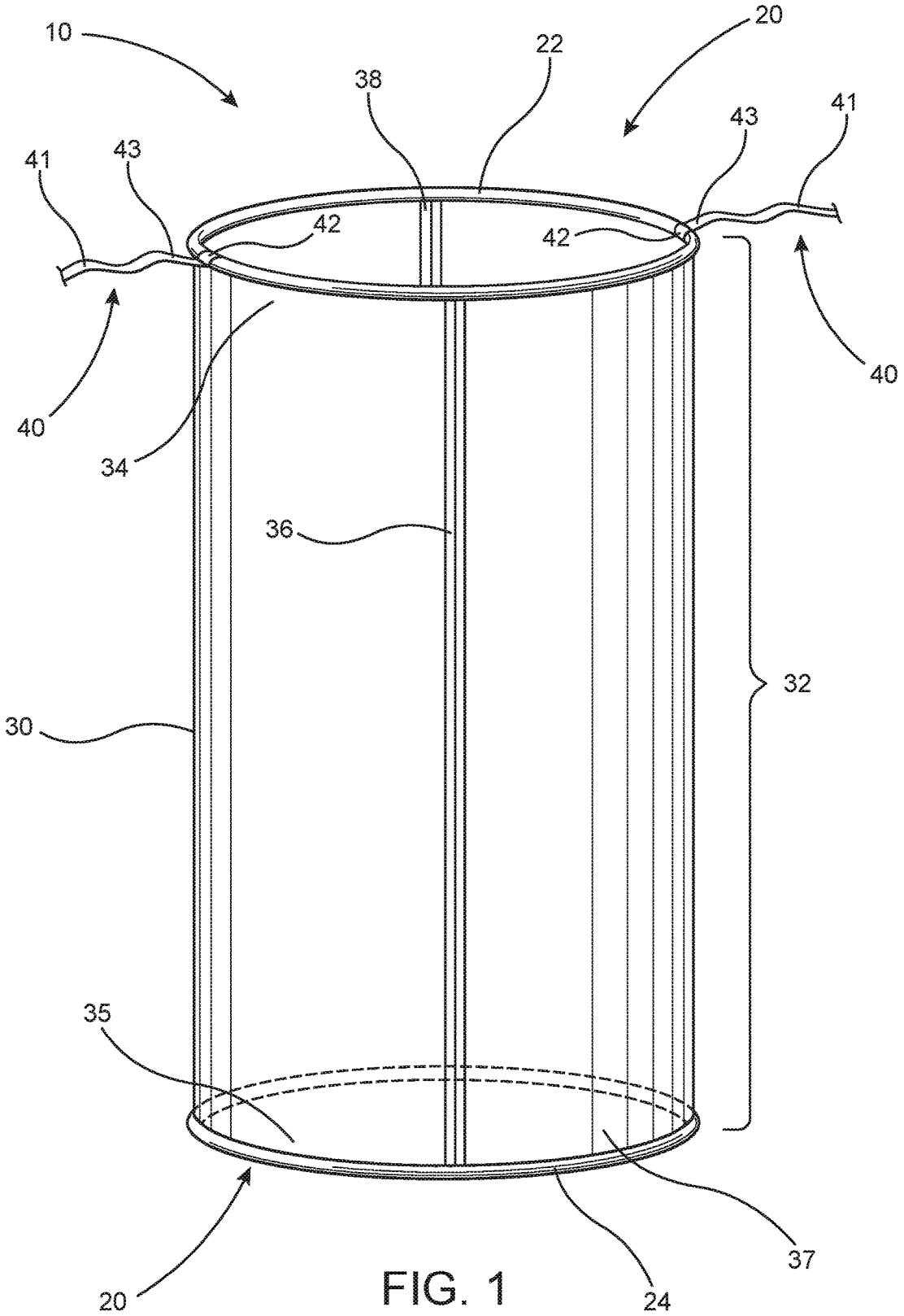
FIG. 1 is a perspective view of one embodiment of the canopy assembly according to the present invention comprising a screen disposed in an "expanded orientation."
Figure 2:
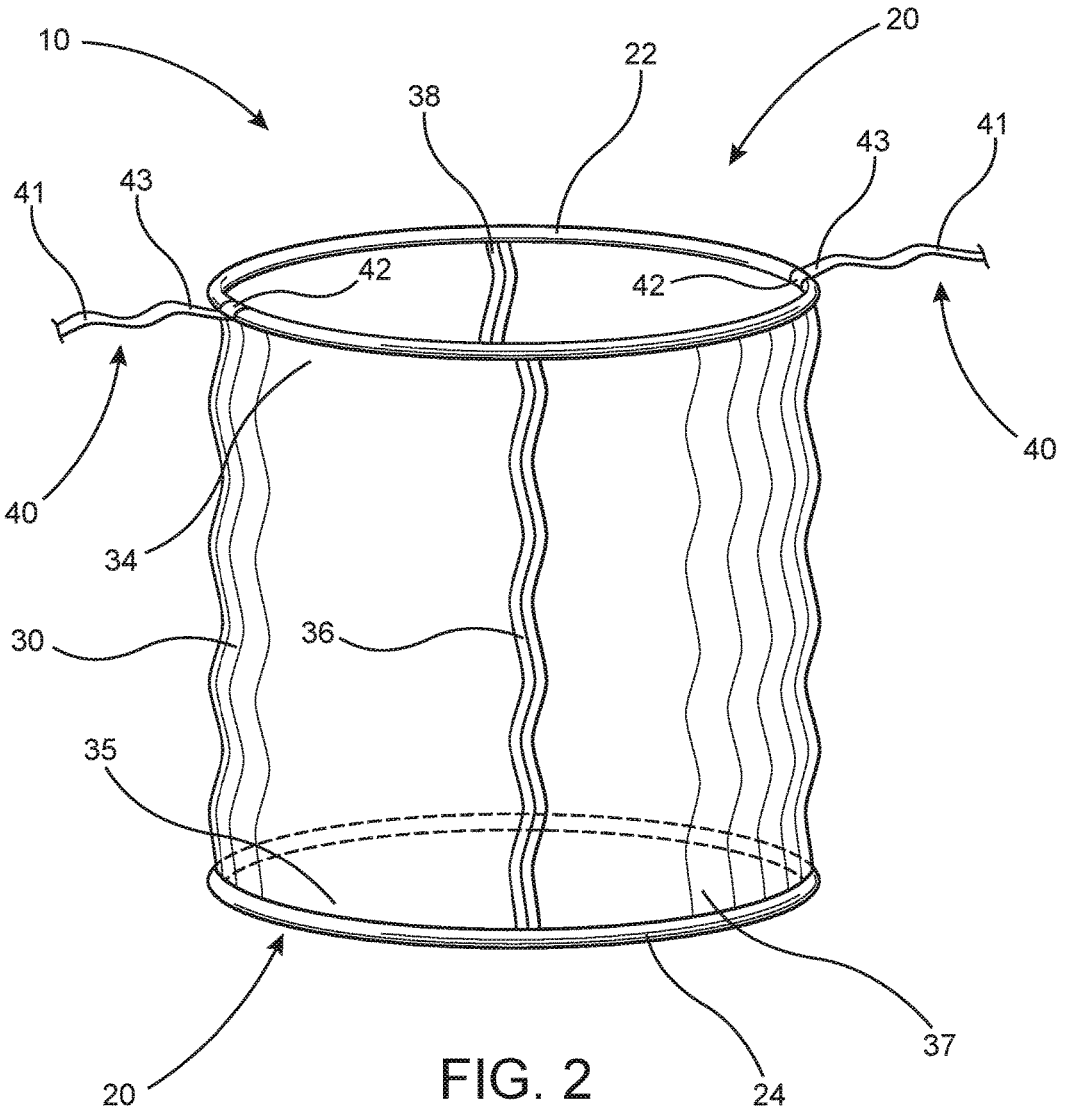
FIG. 2 is a perspective view of one embodiment of the canopy assembly according to the present invention comprising a screen that is at least partially collapsed.

With initial reference to FIG. 1, the inventive canopy assembly 10 comprises a screen 30 connected to a support assembly 20. The support assembly 20 comprises a first support structure 22 and a second support structure 24, both having a continuous configuration and preferably also a closed configuration. More specifically, the screen 30 comprises a proximal end 34 that is at least partially connected to the first support structure 22. Additionally, the screen 30 also comprises a distal end 35 that is at least partially connected to the second support structure 24. The screen 30 should have a closed configuration, that is the screen 30 should cover or otherwise surround at least a portion of, and preferably the entire, length of the first and second support structures, 22 and 24, so as to provide a privacy enclosure 37 that is fully closed. It is not necessary that the screen 30 be continuously connected to the support structures 22 and 24 over their entire length. However, it is desirable that the screen 30 be connected at least along a majority of the length of both the first and second support structures 22 and 24 to provide better stability to the canopy assembly 10. As can be appreciated from FIGS. 1-7, and 10-11, the first and second support structures 22 and 24 may have a substantially round configuration. As will be subsequently explained in more detail, a substantially round configuration is advantageous to facilitate folding of the support structures. Other configurations are also possible which may include, but are not limited to, a substantially square, rectangular, elliptical, or other similar configurations.

With further reference to FIG. 1, the screen 30 generally extends a height 32. The height 32 may be defined as the distance that the screen 30 extends between the first and the second support structures 22 and 24. As previously mentioned, and as shown at least in FIG. 1, due to the closed configuration of the support structures 22 and 24, the screen 30 should form a complete enclosure on the inside of the first and second support structures 22 and 24. Inside of this privacy enclosure, generally represented as 37, is a privacy space that may be defined as the area inside of the screen 30 and on the inside of the first and second support structures 22 and 24, extending substantially along the height 32 of the screen 30. The privacy enclosure 37, and more specifically its footprint, should be sufficient to accommodate individuals of different sizes. By way of example only, in embodiments of the canopy assembly 10 wherein both the first and the second support structures 22 and 24 comprise a substantially round configuration, the diameter of the screen 30 may range from about 36 inches to about 60 inches. Similarly, the height 32 of the screen 30 should also be sufficient to provide a privacy enclosure 37 for individuals of different heights. Additionally, the height 32 of the screen 30 may also vary according to the size of the vehicle 100 to which the canopy assembly will be attached. Also by way of example, the height 32 of the screen 30 may vary from about 60 inches to about 72 inches.

With reference now to FIGS. 1-5, and 10-11, the canopy assembly may comprise an attachment assembly, generally indicated as 40. The attachment assembly 40 generally comprises at least two attachment structures, indicated as 41. Each attachment structure 41 generally comprises a proximal end 43, a distal end 44, and an attachment device 45.

The attachment structures 41 may comprise a material that is flexible so that it may be folded or otherwise collapsed for storage purposes. Importantly, the attachment structures should comprise a material capable of supporting the weight of the canopy assembly 10. By way of example, the attachment structures 41 may be in the form of an elongated strap, a cord, or a line.

The proximal end 43 of each attachment structure 41 is generally connected to at least a portion of the first support structure 22, such as at 42. Conversely, as is best shown in FIGS. 10-11, the distal end 44 is generally connected to a supporting structure, such as the vehicle 100. The distal end 44 of the attachment structure 41 is generally connected to the vehicle 100 via the attachment device 45. The attachment device 45 may be in the form of a "suction cup" or a similar structure comprising an elastic material. The attachment device 45 may be a "suction cup" that may be pushed into the supporting structure, or vehicle 100, to force air out of the "suction cup." As the material of the "suction cup" retreats to its natural position, the attachment device 45 is secured to the supporting structure or vehicle 100 due to the negative pressure exerted during the process. As is shown at least in FIG. 11, and in order to ensure stability of the canopy assembly 10, at least two attachment structures 41 should be connected, around their proximal ends 43, to different portions 42 of the first support structure 22. Also as shown in FIG. 11, and also to ensure stability of the canopy assembly 10, corresponding attachment devices 45 should connect the two attachment structures 41 to different attachment points or parts of the vehicle 100, such as 102 and 104, as indicated in FIGS. 10 and 11.

Figure 4:
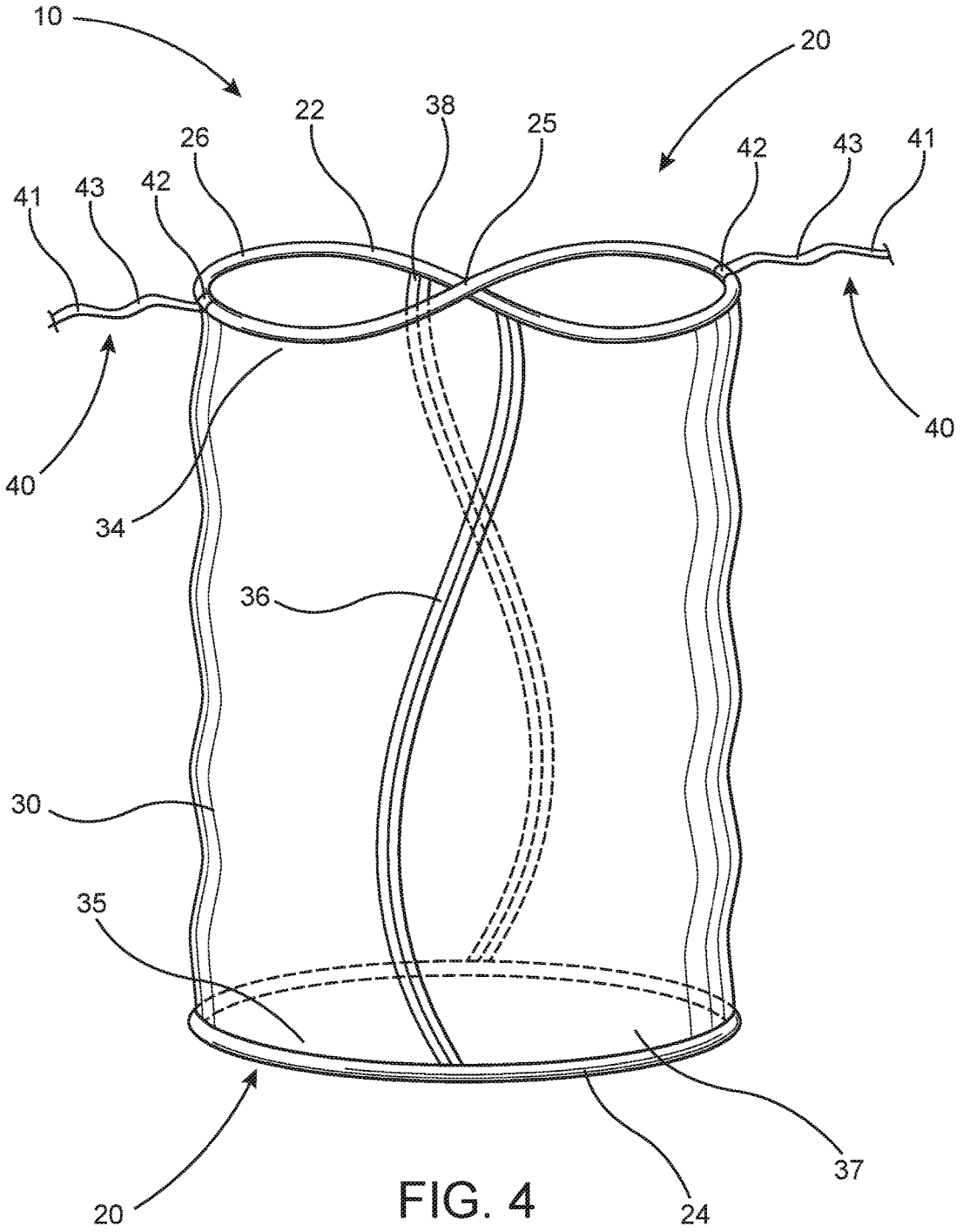
FIG. 4 is a perspective view of one embodiment of the canopy assembly according to the present invention comprising a folded first support structure and a screen that is at least partially collapsed.
Figure 5:
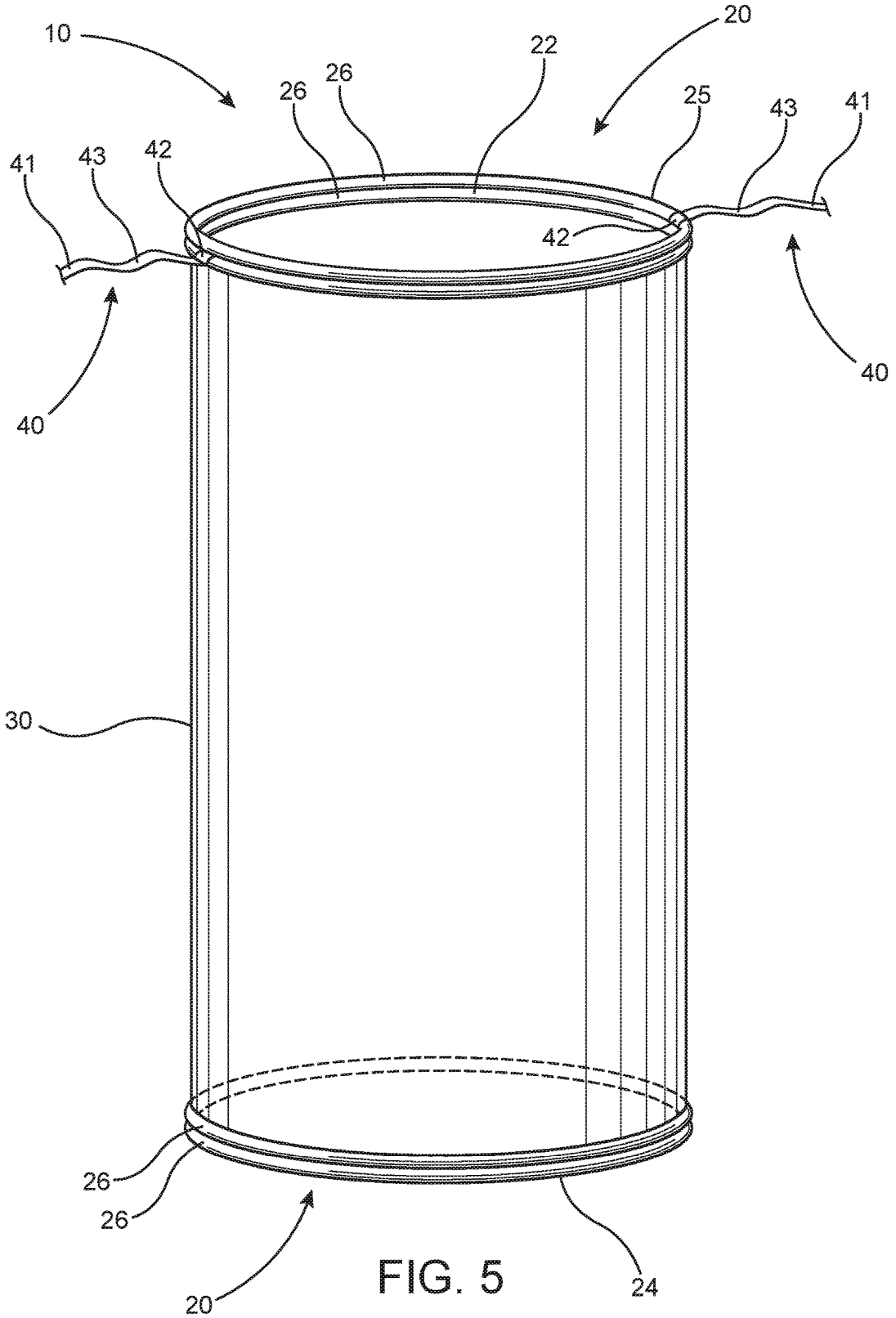
FIG. 5 is a perspective view of one embodiment of the canopy assembly according to the present invention comprising a first and a second support structure each disposed in a "double loop" or "stacked" configuration.

With reference now to FIGS. 4-7, the first 22 and second 24 support structures of the support assembly 20 should comprise a "bendable material" capable of being folded upon itself. Although the "bendable material" should be capable of being folded, the "bendable material" should also be sufficiently strong and/or stable to support the screen 30. The illustrative embodiment as represented in FIG. 4, shows how the "bendable material" permits folding or otherwise bending the first support structure 22. As shown in FIG. 4, the first 22 (and/or the second 24) support structure may be folded or otherwise bent upon itself so that relatively opposite sections touch or otherwise intersect at a point 25. As shown at least in FIGS. 5-7, opposite ends 26 of the first 22 or second 24 support structure may then be brought within sufficient proximity, resulting in a "double loop" or "stacked" configuration of the first 22 (and/or the second 24) support structure. This "double loop" or "stacked" configuration is advantageous for storage of the canopy assembly 10. A substantially round configuration facilitates achieving a "double loop" configuration because the support structures 22 and 24 may be folded along the direction of the curvature of the round configuration.

Figure 8:
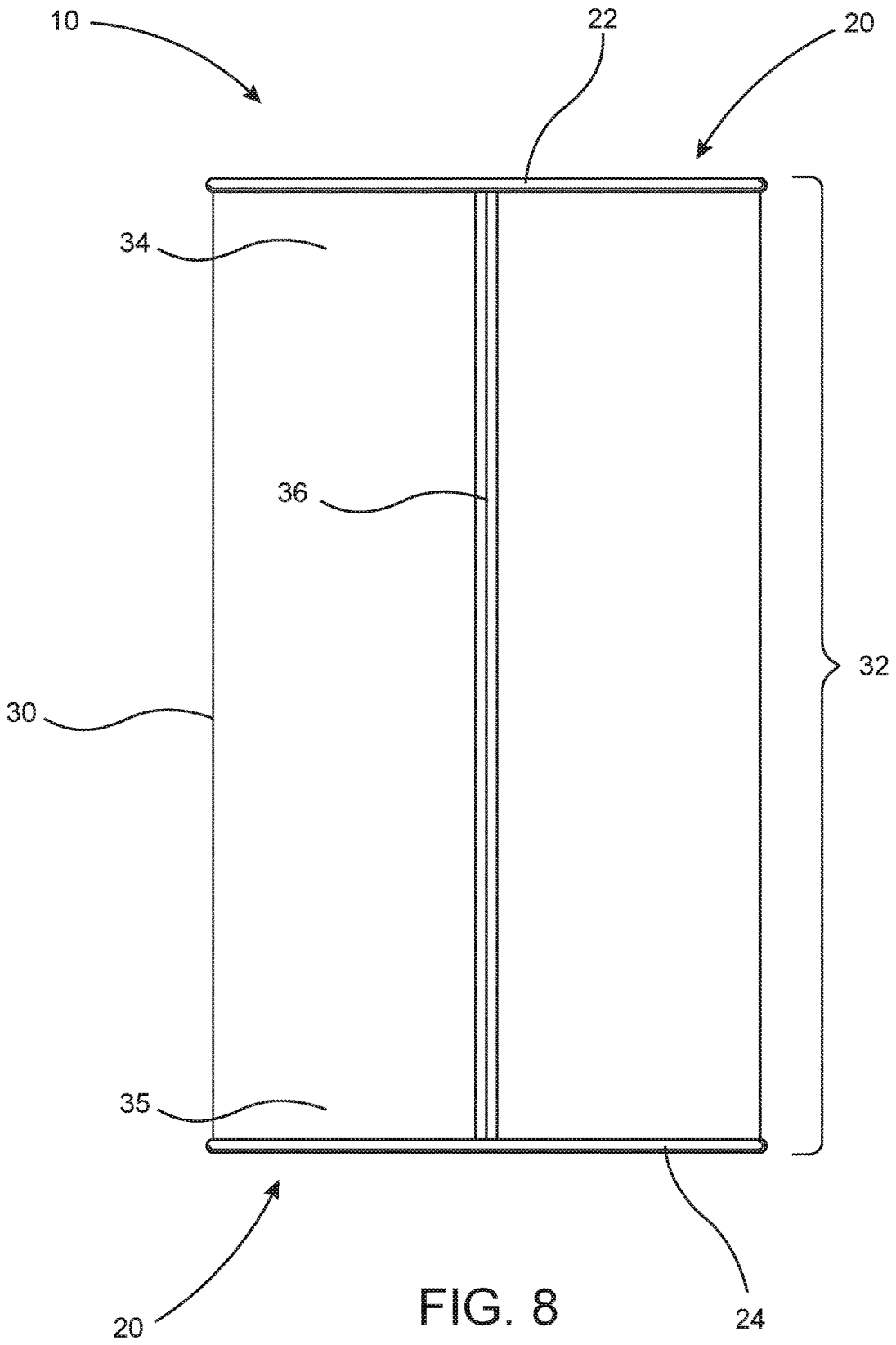
FIG. 8 is a front view of one embodiment of the canopy assembly according to the present invention comprising a screen disposed in an "expanded orientation."
Figure 9:
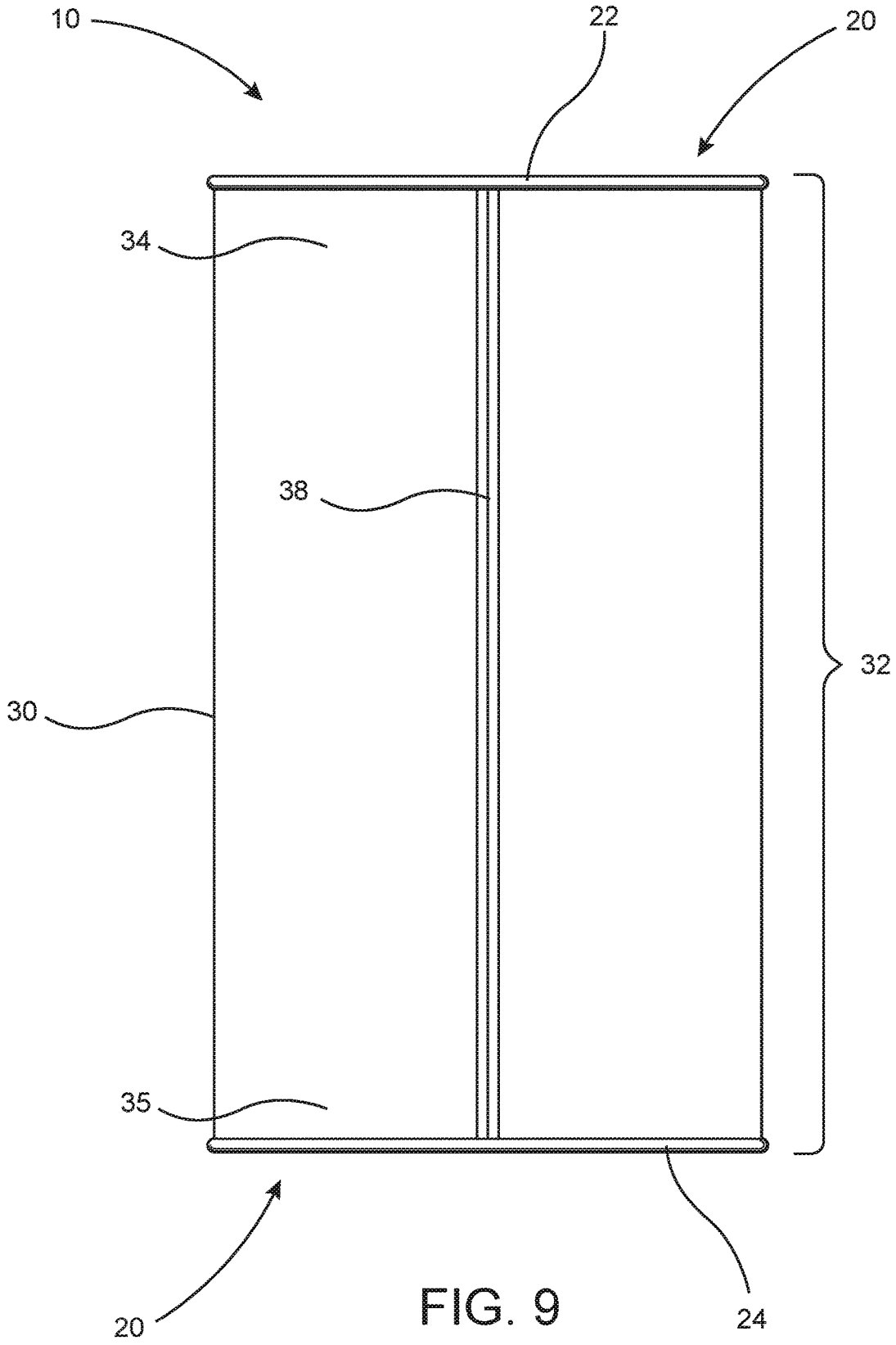
FIG. 9 is a rear view of one embodiment of the canopy assembly according to the present invention comprising a screen disposed in an "expanded orientation."

The canopy assembly 10, and more specifically the screen 30, may be disposed in an "expanded orientation" and in a "collapsed orientation." The embodiments as represented in FIGS. 1, 8-9, and 11 show the "expanded orientation" of the canopy assembly 10. In the "expanded orientation," the canopy assembly 10 is disposed in a substantially vertical or upright position wherein the proximal 34 and distal 35 ends are also upper and lower ends. In the vertical or upright position, the first support structure 22 supports the screen 30 in a dependent relation wherein the screen 30 is connected to the first support structure 22 and suspends therefrom in a vertical direction. The "expanded orientation" further comprises the first 22 and second 24 support structures being disposed in spaced relation to one another so that the canopy assembly, and more specifically the screen 30, extends substantially the full height 32 of the screen 30. As is represented in FIGS. 1, and 8-9, the first 22 and the second 24 support structures should be disposed in a substantially centered alignment relative to one another. That is, the approximate center of both the first 22 and second 24 support structures should be substantially aligned. If the inventive canopy assembly 10 is used on a sloped surface or otherwise uneven surface, both support structures 22 and 24 need not be in a parallel alignment relative to each other as the second support structure 24 may conform to the geometry of the surface.

As previously mentioned, the first 22 and the second 24 support structures may comprise a substantially round configuration, such as in the illustrative embodiment as represented in FIG. 1. As shown in the illustrative embodiment of FIG. 1, disposition of the screen 30 into the "expanded orientation" should result in the screen 30 forming a substantially cylindrical privacy enclosure 37. Also as previously mentioned, the privacy enclosure may be substantially defined as the space or area inside of the screen 30 and between the support structures 22 and 24. As may be appreciated from FIG. 1, the first 22 and second 24 support structures should each form open ends both at the top and at the bottom of the canopy assembly 10. Thus, the feet of a person standing inside of the canopy assembly 10, and within the privacy enclosure 37, should touch the ground or floor below. Similarly, and depending on height, the head and/or shoulders of the individual standing inside of the canopy assembly 10 may extend above the open end formed by the first support structure 22.

With reference to FIGS. 1-4, and 8-11, the screen 30 generally comprises at least two openings, generally indicated as 36 and 38. Each the openings 36 and 38 is generally configured and dimensioned so that an individual may pass therethorugh. As is perhaps best represented in FIG. 11, when the screen 30 is connected to the vehicle 100, while being disposed in the "expanded orientation," at least one of the openings of the screen 30, such as 36, should communicably connect an exterior of the canopy assembly 10, and the screen 30, to an interior thereof, such as the privacy enclosure 37. At least a different opening, such as 38, should communicably connect the interior of the canopy assembly, such as the privacy enclosure 37, to the interior of a vehicle 100. The illustrative embodiment as represented in FIG. 11 shows a vehicle 100 with an open door, wherein an attachment structure 41 connects the canopy assembly 10 to a side of the vehicle 102. Also in FIG. 11, a different attachment structure 41 connects the canopy assembly 11 to a different side of the vehicle 104, which may be the exterior of the window of the door located on the passenger side of the vehicle 100. In the illustrative embodiment of FIG. 11, the operative orientation of the canopy assembly 10 is further defined by the canopy assembly 10 being disposed in the expanded orientation, adjacent an interior of a vehicle door, wherein opening 38 is disposed in communication with the interior of the vehicle 100. Therefore, an individual may enter the canopy assembly 10 through an opening 36, change clothes within the privacy enclosure 37, and directly enter the vehicle 100 through a different opening 38 without having to exit the canopy assembly 10.

Figure 3:
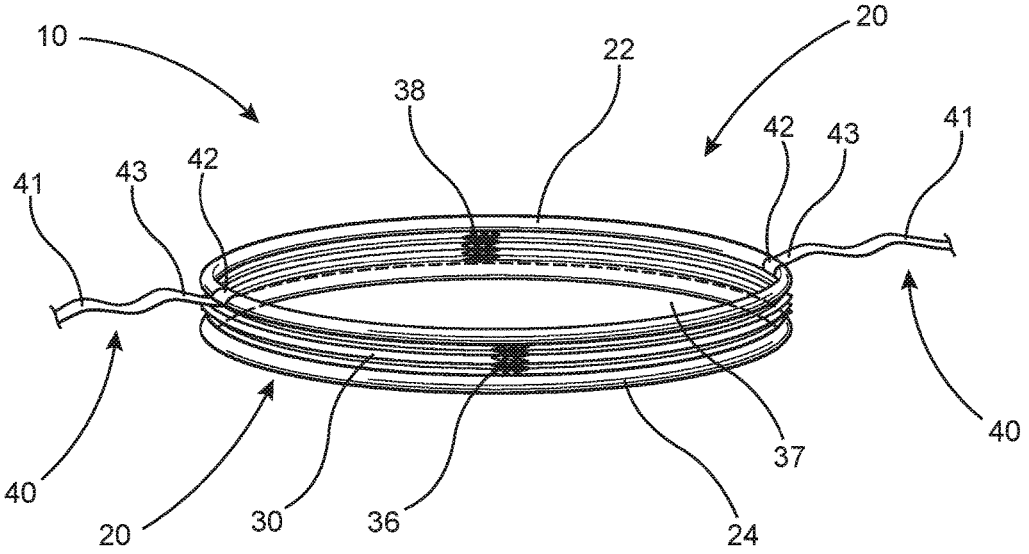
FIG. 3 is a perspective view of one embodiment according to the canopy assembly according to the present invention comprising a screen disposed in a "collapsed orientation."
Figure 6:
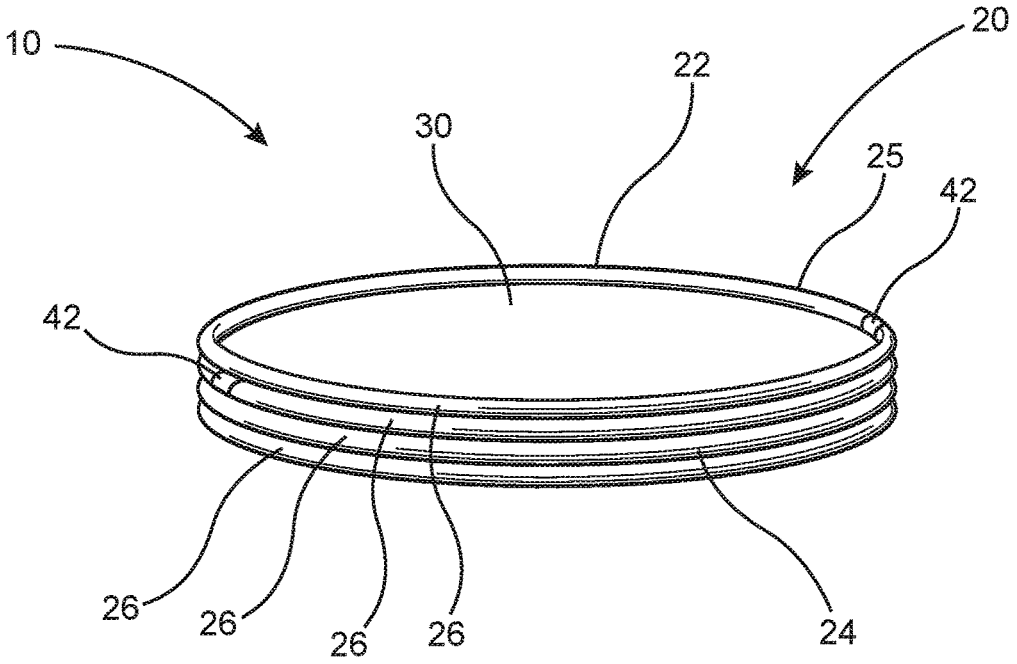
FIG. 6 is a perspective view of one embodiment of the canopy assembly according to the present invention comprising a screen disposed in a "collapsed orientation" and both the first and second support loops disposed in a "double loop" or "stacked" configuration.
Figure 7:
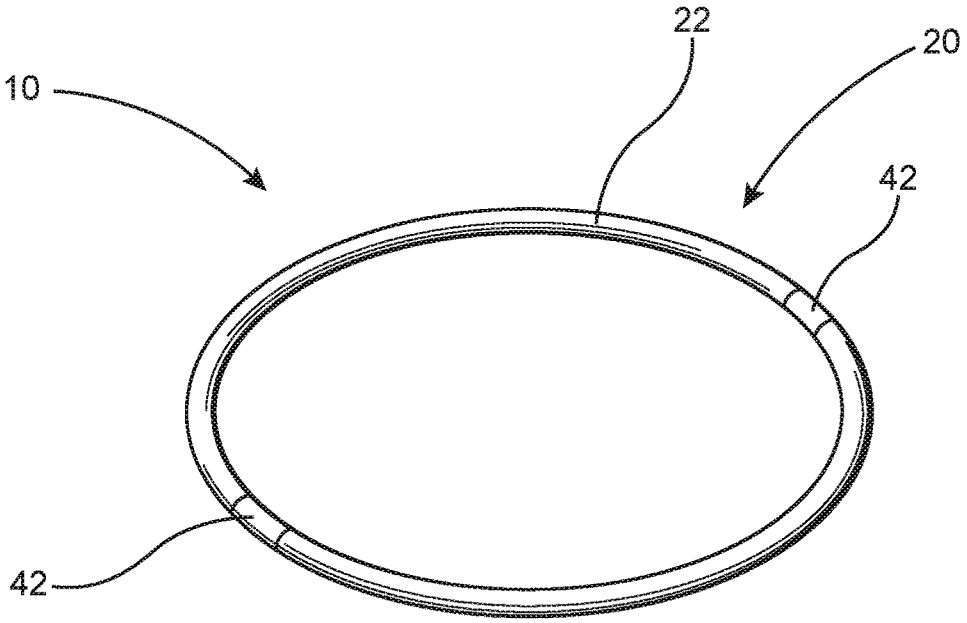
FIG. 7 is a top view of one embodiment of the canopy assembly according to the present invention.

As previously mentioned, and as represented at least in FIGS. 3 and 6, the screen 30 of the inventive canopy assembly 10 may be disposed in a "collapsed orientation." As represented in FIG. 3, the "collapsed orientation" comprises the screen 30 being folded or otherwise collapsed so that the first 22 and the second 24 support structures are no longer in a spaced relation. Instead, in the "collapsed orientation," the first 22 and second support structures may be in an adjacent relation to one another. Further, as is represented in the illustrative embodiment of FIG. 6, the "collapsed orientation" may also comprise the first and the second support structures 22 and 24 being disposed in a "double loop" or "stacked" configuration. The "collapsed orientation" of the screen 30 allows for greater practicality when storing the canopy assembly 10 as it reduces the effective space that the canopy assembly 10 occupies. Furthermore, a round configuration of the first and second support loops 22 and 24 facilitates achieving the "double looped" or "stacked" configuration.

As represented at least in FIGS. 2-4, and 6, the material of the screen 30 should be flexible so that it may at least partially conform to the geometry of the support structures 22 and/or 24, and so that the screen 30 may be easily collapsed or folded for storage. In order to provide an effective privacy enclosure 37, the material of the screen 30 should comprise a color that is non-transparent or non-translucent. By way of example only, the material of the screen 30 may comprise an opaque color. Other non-translucent or non-transparent colors are also within the scope of the present invention.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A canopy assembly structured to provide privacy adjacent to a vehicle, said canopy assembly comprising:

a support assembly, a screen connected to at least a portion of said support assembly, an attachment assembly comprising at least one attachment structure connected to a portion of said support assembly, said at least one attachment structures disposed and structured to support said screen in an operative orientation, at least two openings disposed on said screen each extending substantially along a height of said screen, said screen and said support assembly collectively disposable into an expanded orientation and a collapsed orientation, each of said at least two openings configured and dimensioned to allow passage therethorugh of an individual, when in said expanded orientation, said operative orientation comprising said screen disposed in said expanded orientation and in depending relation from said support assembly, adjacent an interior of a vehicle door, concurrent to one of said at least two openings disposed in direct communication with a vehicle interior, and said expanded orientation further comprising a privacy enclosure at least partially defined by said screen having a closed configuration.

2. The canopy assembly as recited in claim 1 wherein said support assembly comprises a first support structure having a substantially elongated continuous configuration; said screen connected to said first support structure substantially along the length thereof.

3. The canopy assembly as recited in claim 2 wherein said expanded orientation comprises said screen supported in depending relation from said first support structure in a substantially vertical orientation.

4. The canopy assembly as recited in claim 2 wherein said first support structure comprises a substantially round configuration.

5. The canopy assembly as recited in claim 2 wherein said attachment assembly is connected to at least a portion of said first support structure.

6. The canopy assembly as recited in claim 5 wherein said attachment assembly comprises at least two attachment structures each connected to said first support structure along different portions thereof and extending outwardly therefrom into an attachable relation with different parts of the vehicle.

7. The canopy assembly as recited in claim 2 wherein said support assembly comprises a second support structure having a substantially continuous configuration; said screen connected to at least a portion of said second support structure substantially along the length of said second support structure.

8. The canopy assembly as recited in claim 7 wherein said first and said second support structures each comprise a substantially round configuration.

9. The canopy assembly as recited in claim 7 wherein said expanded orientation comprises said first and said second support structures disposed in spaced relation to one another.

10. The canopy assembly as recited in claim 9 wherein said expanded orientation comprises said first and second support structures disposed in substantially centered alignment to one another.

11. The canopy assembly as recited in claim 10 wherein said expanded orientation comprises a substantially cylindrical privacy enclosure formed on an inside of said screen substantially between said first and said second support structures and extending substantially along the height of said screen.

12. The canopy assembly as recited in claim 7 wherein said first support structure comprises a bendable material that at least partially facilitates positioning said screen into and out of said collapsed orientation; said collapsed orientation comprising said first support structure foldable upon itself into a stacked configuration and said screen at least partially conformable to the shape of said stacked configuration.

13. The canopy assembly as recited in claim 7 said first and said second support structures each comprise a bendable material that at least partially facilitates positioning said screen into and out of said collapsed orientation; said collapsed orientation comprising said first and said second support structures each foldable upon itself into a stacked configuration and said screen at least partially conformable to the shape of said stacked configuration.

14. The canopy assembly as recited in claim 13 wherein said collapsed orientation comprises said first and said second support structures disposed in adjacent relation to one another.

15. The canopy assembly as recited in claim 1 wherein said screen comprises a non-transparent material.

16. The canopy assembly as recited in claim 1 wherein said screen comprises a flexible material.

17. A canopy assembly structured to provide privacy adjacent to a vehicle, said canopy assembly comprising:

a support assembly comprising a first support structure comprising a substantially continuous configuration, a screen comprising a flexible and non-transparent material, said screen connected to at least a portion of said first support structure, an attachment assembly comprising a plurality of attachment structures each connected to said first support structure along different portions thereof, said plurality of attachment structures disposed outwardly from said first support structure and structured to support said screen in an operative orientation, a first and a second opening disposed on said screen each as extending substantially along a height of said screen and each configured and dimensioned to allow passage therethorugh of an individual, when in said expanded orientation, said screen and said first support structure collectively disposable into an expanded orientation and a collapsed orientation, said operative orientation comprising said screen disposed in said expanded orientation and in depending relation from said first support structure in a substantially vertical orientation, adjacent an interior of the vehicle door, concurrent to one of said first and second openings disposed in direct communication with a vehicle interior, and said expanded orientation further comprising a privacy enclosure at least partially formed on an inside of said screen extending substantially along the height of said screen.

18. The canopy assembly as recited in claim 17 wherein said first opening is disposed on said screen in opposing relation to the vehicle and in communicating relation between an exterior and an interior of said screen.

19. The canopy assembly as recited in claim 17 wherein said second opening is disposed on said screen in adjacent relation to the interior of the vehicle door and in direct communicating relation between an interior of said screen and an interior of the vehicle.

20. A canopy assembly structured to provide privacy adjacent a vehicle, said canopy assembly comprising:

a support assembly comprising a first support structure including a substantially continuous configuration, a screen comprising a flexible, non-transparent material, said screen and said first support structure collectively disposable into an expanded orientation and a collapsed orientation, a plurality of attachment structures connected to said first support and extending outwardly therefrom in attachable relation to the vehicle; said plurality of attachment structures disposed and structured to support said screen in an operative orientation, said expanded orientation comprising said screen supported in depending relation from said first support structure in a substantially vertical orientation, said expanded orientation further comprising said screen having a closed cylindrical configuration at least partially defining a privacy enclosure, said screen including a first and a second opening each dimensioned to allow passage therethrough of an individual and each extending along a height of said screen, when in said expanded orientation, said first opening disposed on said screen in opposing relation to the vehicle and in communicating relation between an exterior and an interior of said screen, said operative orientation comprising said screen disposed in said expanded orientation adjacent an interior of the vehicle door, concurrent to said second opening disposed in direct communicating relation between with the interior of the screen and an interior of the vehicle, and said collapsed orientation comprising said first support structure folded upon itself into a stacked configuration and said screen disposed in conforming relation to the shape of said stacked configuration.

* * * * *